US005257708A

United States Patent [19]

Dubach

[11] Patent Number: 5,257,708

[45] Date of Patent: Nov. 2, 1993

[54] PLASTIC SNAP HINGE CLOSURE

[75] Inventor: Werner F. Dubach, Maur, Switzerland

[73] Assignee: Createchnic AG, Switzerland

[21] Appl. No.: 33,428

[22] Filed: Mar. 18, 1993

Related U.S. Application Data

[63] Continuation of Ser. No. 834,117, Feb. 11, 1992, abandoned.

[30] Foreign Application Priority Data

Feb. 12, 1991 [CH] Switzerland ..... 00423/91

[51] Int. Cl.[5] ..... B65D 43/24

[52] U.S. Cl. ..... 220/335; 220/339; 215/235

[58] Field of Search ..... 220/335, 339, 254, 259, 220/264; 215/235, 237, 238, 244

[56] References Cited

U.S. PATENT DOCUMENTS

| | | | |
|---|---|---|---|
| 3,289,877 | 12/1966 | Wolf | 220/339 |
| 3,628,215 | 12/1971 | Everburg | 220/339 X |
| 3,629,901 | 12/1971 | Wolf | 220/339 X |
| 3,741,447 | 6/1973 | Miles et al. | 220/339 X |
| 3,933,271 | 1/1976 | McGhie | 220/339 X |
| 4,346,810 | 8/1982 | Kneissl | 215/237 |
| 4,386,714 | 6/1983 | Roberto et al. | 220/339 |
| 4,403,712 | 9/1983 | Wiesinger . | |
| 4,414,705 | 11/1983 | Ostrowsky | 220/339 X |
| 4,487,324 | 12/1984 | Ostrowsky | 215/253 |
| 4,545,495 | 10/1985 | Kinsley | 215/235 |
| 4,573,600 | 3/1986 | Dubach . | |
| 4,854,473 | 8/1989 | Dubach . | |
| 4,915,268 | 4/1990 | Lay et al. | 220/339 X |
| 5,067,624 | 11/1991 | Tanisch | 215/235 |
| 5,115,931 | 5/1992 | Dubach | 215/235 |

FOREIGN PATENT DOCUMENTS

| | | | |
|---|---|---|---|
| 1056979 | 2/1967 | United Kingdom | 220/339 |

*Primary Examiner*—Allan N. Shoap
*Assistant Examiner*—Stephen K. Cronin
*Attorney, Agent, or Firm*—Speckman, Pauley & Fejer

[57] ABSTRACT

A plastic snap hinge closure having tension elements disposed on a plastic closure including a lower part and an upper part which are connected with each other via a main hinge A desired snap effect is achieved by means of lengths of the tension elements which can be changed by the action of a pull. The tension elements extend in planes between the attachment points. Each tension element has partial sections which cause the change in length. The partial sections are either C-shaped, U-shaped, or O-shaped. The tension elements permit a maximum percentage change of length of each tension element of approximately 10% to 50%.

16 Claims, 4 Drawing Sheets

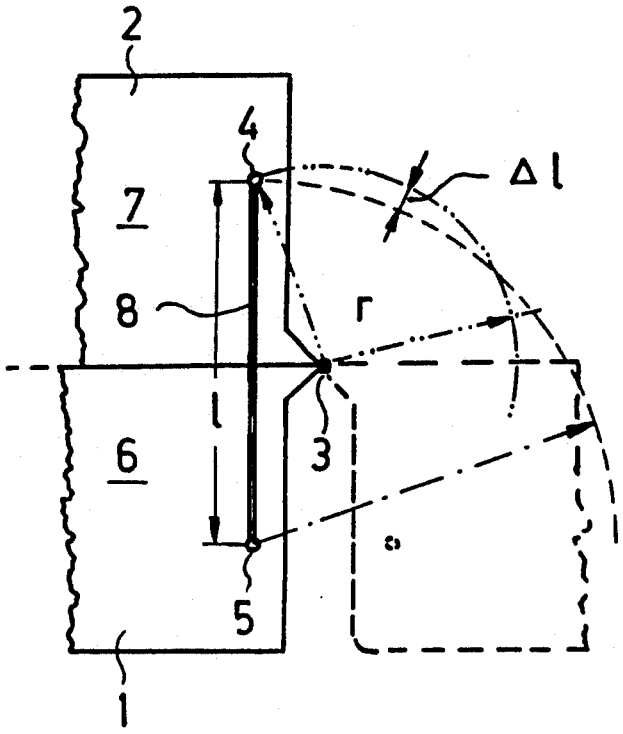
FIG. 1
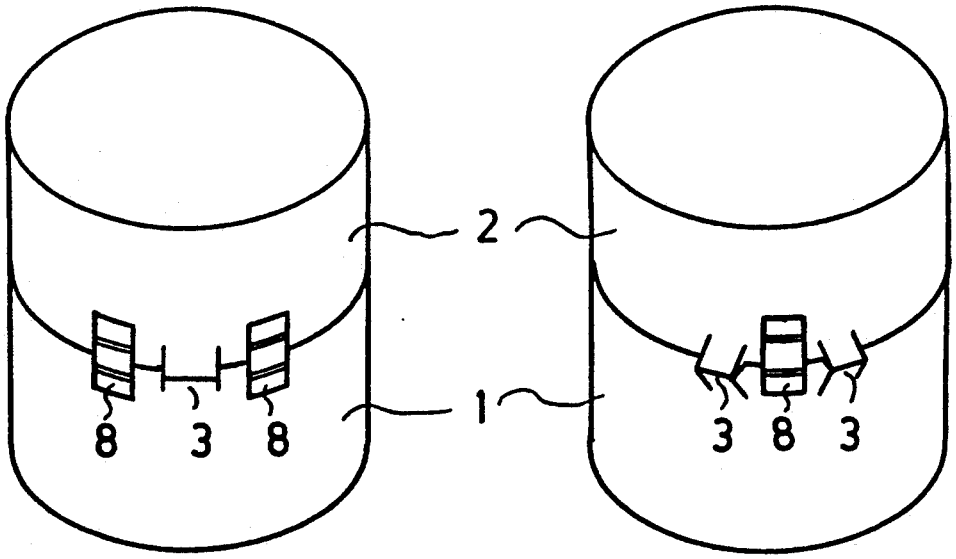
FIG. 2a
FIG. 2b

PLASTIC SNAP HINGE CLOSURE

This is a continuation patent application of co-pending patent application having Ser. No. 07/834,117, filed on Feb. 11, 1992, now abandoned.

BACKGROUND OF THE INVENTION

1. Field of the Invention

This invention relates to a plastic snap hinge closure having a lower part and an upper part connected with it by means of a film hinge, where the closure shell walls in the area of the hinge extend straight or curved and have at least one tension element connected with both closure parts in one piece, and each tension element has, directly or indirectly, an attachment point on the shell walls of both parts.

2. Description of the Prior Art

Conventional plastic snap hinge closures are known, for example, from my European Patent Disclosures Nos. 0 147 423 and 0 291 457. In the first mentioned patent disclosure, the tension elements are tension straps, which are produced by means of injection molding over consoles on the shell wall of the lower part and of the lid and thus are located in one plane. In the second mentioned patent disclosure, the tension straps are disposed extending approximately in or on the shell wall.

In the first mentioned example, the tension straps extend in one plane in the closed position and the attachment points of the tension straps are displaced out of the shell wall by consoles in such a way that they are located parallel to the main axis. In the second mentioned example, the tension straps extend in two planes which between them enclose an angle. Accordingly, the outer sections of each of the tension straps must travel a greater distance during opening than the inner sections of the straps located more closely to the hinge.

According to Wiesinger, European Patent Disclosure No. 0 056 469, instead of tension straps triangular intermediate elements, which verge with their tips into the main hinge, are disclosed.

Regarding an explanation of the operation of various conventional snap hinge closures, tension straps taught by the two first mentioned patent disclosures are supposed to elastically stretch and thus provide a snap effect. In practice, however, plastic materials used for plastic closures hardly have the ability of stretching elastically. This means that the desired snap effect cannot actually be achieved.

The function in connection with another embodiment taught by European Patent Disclosure No. 0 056 469 is correctly explained. The action of the snap closure is based on the elastic deformation of the closure in the area of the hinge. This means that in the course of each opening or closing of the closure, the shell wall of the lower part or the lid, or of the entire lid, arches in the area of the passage across the dead center position in the course of operation and subsequently is bent back into the relaxed, non-deformed shape.

Of course, this is an undesirable cooperation of forces which are hard to predict and interact in a complex manner. Attainment of the snap action can only be determined empirically and is difficult to predict. Easier to predict are results in connection with snap closures operating with a toggle joint, one of the levers of which extends into the surface of the lid and the other into the shell wall of the lid and the lower part. With these conventional closures, the snap effect depends on the force required to deform the two levers of the toggle joint. However, a hinge of this type is only suitable for closures having a small spout, where the lid itself does not close off the spout, but a sealing element placed thereon and cooperating with the spout closes off the spout, since the lid itself cannot seal because of the cuts along the toggle joint.

Accordingly it is desired to provide snap hinge closures, the snap effect of which does not depend on the elastic action of some arbitrary part of the closure, except for the tension element.

SUMMARY OF THE INVENTION

It is one object of this invention to provide a plastic snap hinge closure in which a snap effect can be achieved with at least one tension element.

According to one preferred embodiment of this invention, this object is achieved with a plastic snap hinge closure in which the at least one tension element includes a plurality of partial sections which, in the closed state of the closure, extend wholly or with successive portions of the partial sections at least approximately in the plane between the attachment points, and that in the course of operation of the closure each partial section provides a change in length because of elastic deformation.

Further advantageous embodiments of the subject of the invention ensue from the dependent claims and are explained in the following description in conjunction with the drawings.

BRIEF DESCRIPTION OF THE DRAWINGS

FIG. 1 is a schematic functional view of the snap effect of a snap hinge closure in accordance with this invention, equipped with a longitudinally variable tension element;

FIGS. 2*a* and 2*b* are each a perspective view of a round snap hinge closure showing the position of the tension elements or of the tension element in relation to the main hinge;

FIGS. 3*a* to 5*b* show three different embodiments of length-adjustable tension elements of round closures, wherein FIGS. 3*a*, 4*a* and 5*a* each show a rear view, looking towards the hinge of the closed closure, and wherein FIGS. 3*b*, 4*b* and 5*b* each show a top view of the respective embodiments in a completely opened state;

FIG. 8*a* shows a side view corresponding to the completely opened position of the closure, after manufacture;

FIG. 8*b* shows the tension element of FIG. 8*a* in a position when the closure is completely opened;

FIG. 8*c* shows a tension element in the dead center position of the closure at maximum stretch; and FIG. 8*d* shows the tension element of FIG. 8*c* in a completely closed position.

DETAILED DESCRIPTION OF PREFERRED EMBODIMENTS

Figures 3A, 4A, 5A:
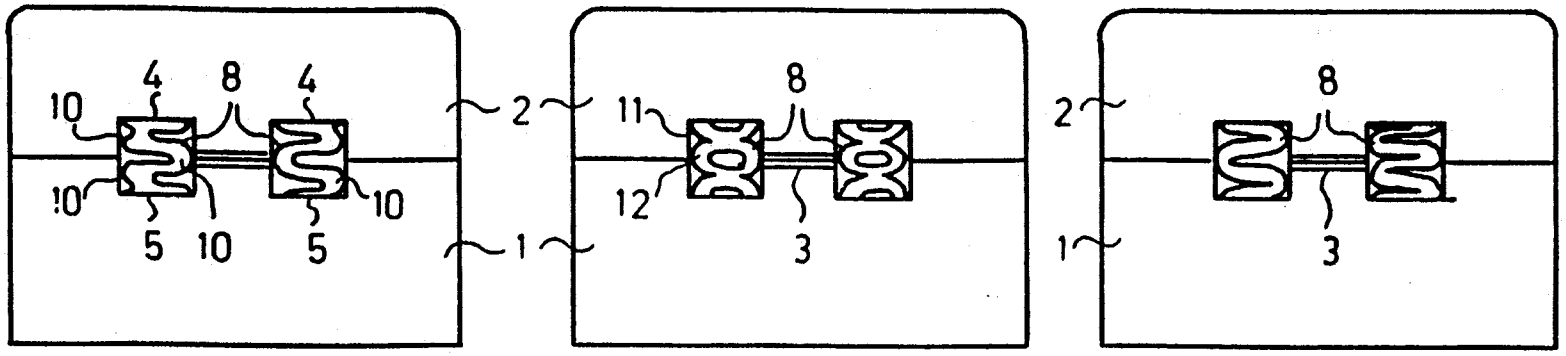

One preferred mode of operation of the closure in accordance with this invention is illustrated in the schematic view in accordance with FIG. 1. A lower part 1 of the closure can be placed, for example, on a container. In a closed position of the closure, the lower part 1 is covered by an upper part 2. In this way, the upper part 2 forms a lid or cap on the lower part 1. The two parts 1 and 2 are connected in one piece via a film hinge 3. The film hinge 3 forms the axis of rotation in relation to which the upper part 2 can be pivoted approximately 180° with respect to the lower part 1. The film hinge 3 is outwardly displaced relative to the shell wall 6 of the lower part 1 and to the shell wall 7 of the upper part 2, which is preferably aligned with shell wall 6.

To be able to produce the closure by injection molding in a completely open position, the film hinge 3 must be positioned outside of the shell walls 6 and 7. A schematically shown tension element is designated by the reference numeral 8. The tension element 8 has an upper attachment point 4, at which the tension element 8 is fastened on the upper part 2, and a lower attachment point 5, at which the opposite end of the tension element 8 is fastened on the lower part 1. Because the axis of rotation, formed by the film hinge 3, as well as the upper attachment point 4 of the tension element 8 are fixedly positioned on the closure, the upper attachment point 4 moves about the film hinge 3 on an arc of a circle with the radius r. However, the tension element 8 is not fastened in the axis of rotation of the film hinge 3 but rather on the lower attachment point 5 and therefore attempts to rotate about the lower attachment point 5. If the tension element 8 cannot be elongated, the upper attachment point 4 has to move on an arc of a circle having a radius l, where l corresponds to the length of the tension element 8. The difference between these two radii r and l with different axes of rotation inevitably results in a change in the length of the tension element 8. This change in length is shown in the drawing by $\Delta l$. This change in length generates the force required for the snap effect. The tension elements can be designed so that such a change in length can be effected. Thus the force with which the closure performs a snap effect depends on relatively simple geometric considerations. In contrast to the snap hinge closures described in the beginning, the difficult-to-predict change in the shape of the closure itself is not important in the mode of operation described above. The degree of elasticity can be affected by the design of the tension elements. Maximum change in length $\Delta l$ and the location of the dead center position are essentially only dependent from the disposition of the attachment points 4, 5 relative to the film hinge 3. In this way, the designer has a large degree of freedom with respect to the design of a closure, in accordance with this invention. If, for example, in the preferred embodiment illustrated the two attachment points 4, 5 are placed further inward while maintaining the length of the tension element 8, the radius r is increased by this and $\Delta l$ changes as well as the angular position of dead center. The optimization of the snap effect can be derived directly from the drawing without experimentation. If the possible change in length $\Delta l$ is comparatively great, the tolerance range regarding the disposition of the attachment points of the tension element is also great. This is in clear contrast to the plastic snap hinge closures known so far, which only permit a small range of tolerance with respect to the geometric arrangement.

FIGS. 2*a* and 2*b* each show a snap hinge closure in a perspective view for the purpose of explaining the possible disposition of the snap hinge. The embodiment according to FIG. 2*a* shows a relatively narrow film hinge 3, via which the lower part 1 is hingedly connected with the upper part 2, and on both sides the film hinge 3 is a tension element 8, each positioned at the same distance from the film hinge 3. In contrast thereto, the embodiment in accordance with FIG. 2*b* shows two film hinges 3 at a certain distance from each other and a centrally disposed tension element 8. In the construction of non-cylindrical plastic closures, it is possible to realize different combinations of one or more film hinges 3 with one or a plurality of tension elements 8.

Three plastic snap hinge closures in accordance with the embodiment of FIG. 2*a* are shown in FIGS. 3*a*, 3*b*, 4*a*, 4*b*, 5*a*, and 5*b*, which only differ in the design of the tension elements 8.

Figures 3B, 4B, 5B:
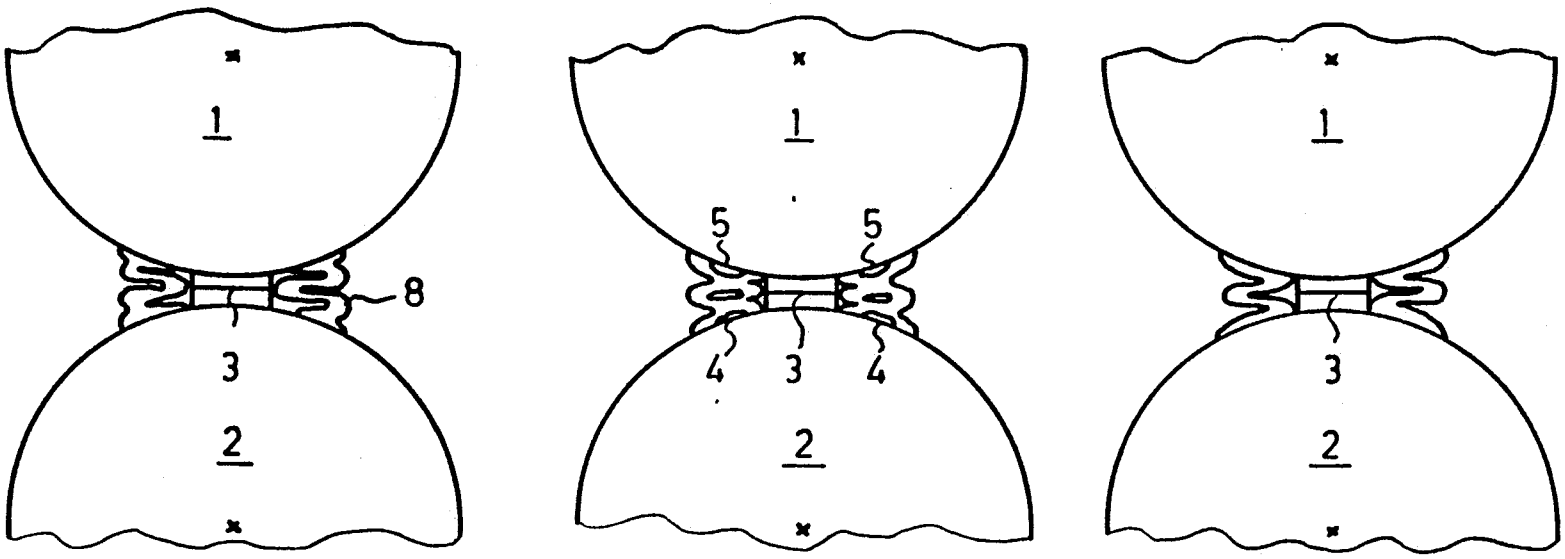

If FIGS. 3*a*, 4*a*, and 5*a* are considered, which each show the rear view of a closed closure, it is clear that the attachment points 4, 5 of each individual tension element 8 extend parallel to each other when the closure is closed. However, in FIGS. 3*b*, 4*b* and 5*b*, the hinge areas of the respective closures are shown in the completely open position of the latter. In this position, each of the attachment points 4, 5 extends obliquely to the other. It is possible to design the tension elements 8 in such a way that they are located straight in one plane in the completely open position of the closure, as shown in FIGS. 3*b*, 4*b* and 5*b*, but are completely relaxed. This would correspond to the manufacturing position. With this disposition of the tension elements 8, they would already be slightly stretched in the closed position of the closure. Thus, the tension elements 8 exert a certain amount of closing force even in the closed position of the closure. On the one hand, this increases the snap effect and, on the other hand, the closing movement is maintained until last during the course of the snap effect.

The attachment points 4, 5 of the tension elements 8 are each positioned at least approximately aligned with the shell walls in the illustrated examples. However, such arrangement is not necessary. The attachment points 4, 5 could also simply verge over into consoles which are produced by injection molding on the shell walls and which extend outward from the shell walls. This preferred embodiment will be used particularly if it is desired to position the tension elements 8 on a round closure relatively far from the main hinge 3. In this case, an embodiment is also possible where the attachment points 4, 5 of the tension elements 8 extend obliquely to each other. The disposition of the tension elements 8 relative to the main hinge 3 as well as the position of the attachment points 4, 5 with respect to each other will have an effect on the choice of the shape of the tension elements 8 or their partial sections.

The embodiment in accordance with FIGS. 3*a* and 3*b* shows tension elements 8 consisting of three partial sections in the shape of the letter C. The three C-shaped partial section constitute a meandering strap extending in a plane between the two attachment points 4 and 5. The change in length of the tension elements 8 is achieved by spreading the partial sections 10. The more the tension elements 8 are stretched, the wider the C-shaped partial sections 10 are spread. The direction of opening of the C-shaped partial sections 10 alternates in this embodiment, but this is not an absolute requirement.

FIGS. 4*a* and 4*b* show an embodiment where the tension elements 8 do not comprise partial sections. While the partial section adjoining the attachment points 4, 5 are semi-elliptical partial sections 11, a completely elliptical partial section 12 is disposed between them. It is of course also possible that a tension element 8 may comprise three such elliptical C-shaped partial sections. It is simply a question of definition, because five C-shaped partial elements could also be recognized just as easily in this shape. The more that such tension elements 8 are changed in their length, the more the elliptical partial sections are stretched into circular elements.

The embodiment in accordance with FIGS. 5*a* and 5*b* shows tension elements 8 almost identical to those shown in FIGS. 3*a* and 3*b*. Only the partial sections 10 are disposed differently.

Figure 6A:
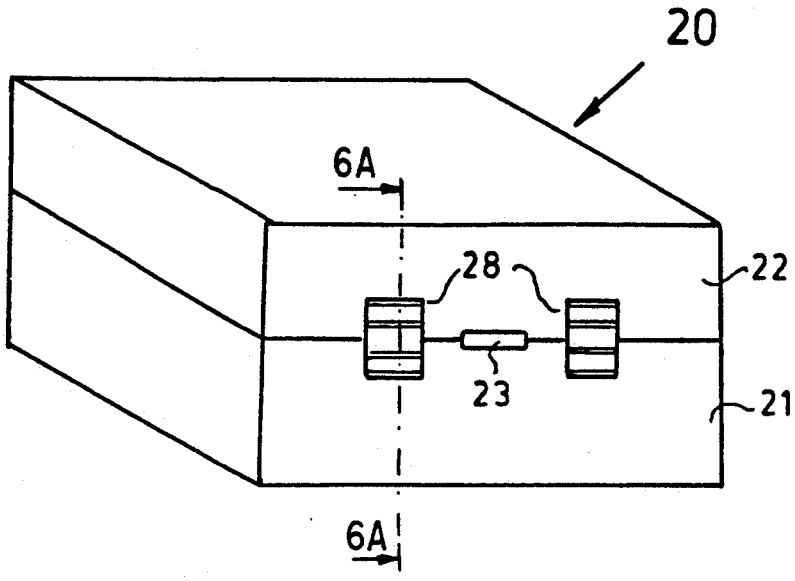
FIG. 6*a* shows another embodiment of this invention with the tension elements in connection with a box.
Figure 6B:
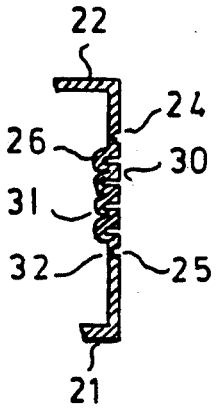
FIG. 6*b* shows a partial sectional view of the box, taken along the line 6A—6A of FIG. 6*a;*
Figure 7:
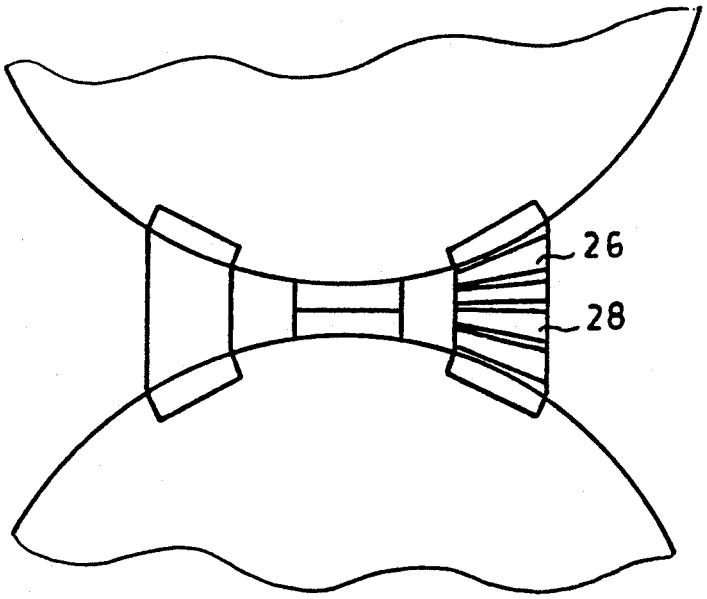
FIG. 7 shows another embodiment of a tension element similar to that shown in FIGS. 6*a* and 6*b*, in use with a round closure in its completely open position.

FIG. 6 shows that the use of the snap hinge closure in accordance with this invention is not limited to the employment of round or otherwise shaped closures of containers. In this embodiment, the snap hinge in accordance with the invention is fixed in a box 20. The box body 21 is connected with the box lid 22 via the main hinge 23. Two tension elements 28 are positioned on both sides of the main hinge 23. Each tension element 28 comprises four U-shaped partial elements 24. In contrast to the embodiments of the tension elements described so far, the partial sections 26 in this embodiment do not extend within the plane formed between the attachment points 24, 25, but they meander in an accordion-like manner out of the plane between the two attachment points. In the embodiment shown in FIG. 6*b*, the tension elements comprise several U-shaped partial elements which adjoin each other in such a way that they have an area which is rounded towards the inside, with respect to the closure, and have a level area towards the outside, with respect to the closure. In this embodiment, the level areas 30 are positioned in such a way that in the closed state of the closure they are located in an aligned plane together with the shell walls. However, the rounded areas 31 of the partial sections 26 extend somewhat into the box, with respect to the shell wall. Such an embodiment of the tension elements is not only suitable for boxes, but also for closures which are fixed on a container. In this embodiment of the tension element, too, the change in length is achieved by spreading the U-shaped partial elements 26. Although not required, the tension elements can be formed by film hinges 32 in the area of the attachment points 24, 25. This has the advantage that the tension elements 28 always extend neatly in the plane between the two attachment points, regardless of the opening position of the closure or the lid 22. This in particular simplifies the design of the injection mold. If such a tension element 28 is attached to a round closure, such as illustrated in FIG. 7, in the completely opened state of the closure, the partial sections 26 form a fan-shaped strap which can be changed in length.

Figure 8A:
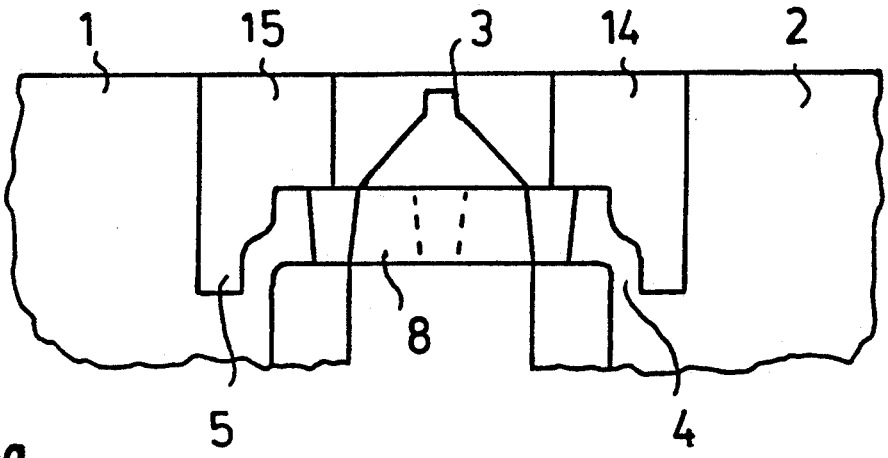
FIGS. 8*a* to 8*d* each show an enlarged view of the tension element in accordance with FIGS. 3*a* and 3*b;*
Figure 8B:
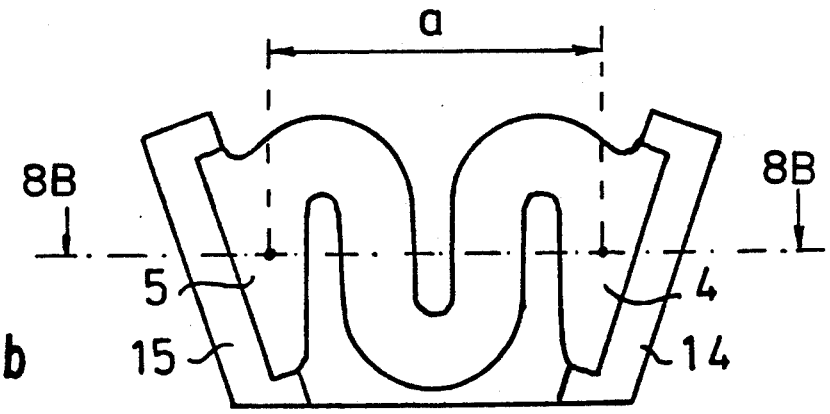
Figure 8C:
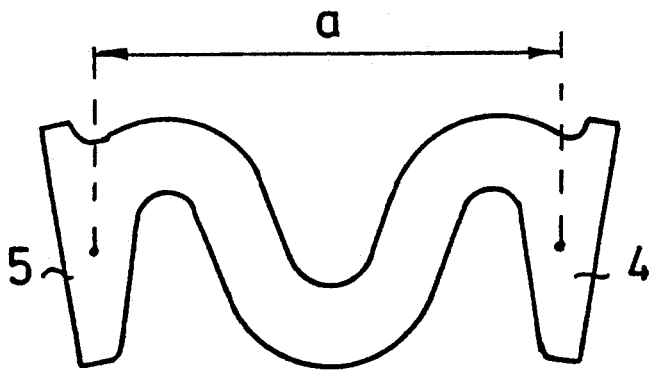
Figure 8D:
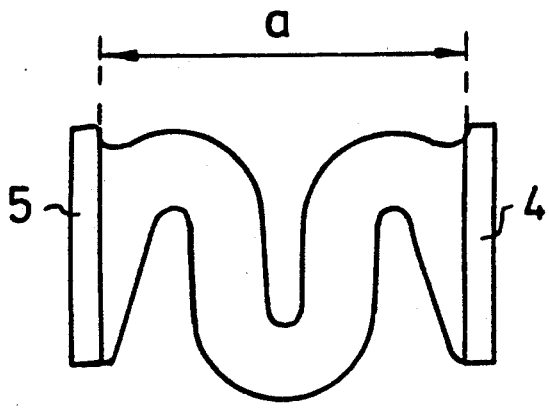

A tension element 8 in accordance with the embodiment of FIG. 3*a* is shown in detail in FIGS. 8*a* to 8*d*. FIG. 8*a* is a partial view of the closure in the area of the hinge. The illustration of FIG. 8*a* corresponds to the position during injection molding, where the closure is completely opened. Again the lower part 1 is connected with the upper part 2 via a film hinge 3. In this embodiment, the tension element 8 extends completely level and the attachment points 4, 5 are disposed in recesses 14, 15 in the upper part 2 and the lower part 1. The same situation is shown in FIG. 8*b* in a top view of the tension strap. The drawing plane is that plane which is formed through the attachment points 4, 5. If the distance between the centers of the two attachment points 4, 5, located on the line 8B—8B as shown in FIG. 8*b*, is measured, it is apparent that in this position the distance is shortest. The embodiment of FIG. 8*b* is shown in a scale of 10:1, and the preferred real or actual distance a is preferably 4.7 mm. However, in FIG. 8*c*, in which the closure is shown in its dead center position, the tension element 8 is changed to its greatest length, i.e. the individual partial elements are spread the widest. In this preferred embodiment, the actual distance a is preferably increased to 6.6 mm. This corresponds to an increase of approximately 40%. In the closed position of the closure as shown in FIG. 8*d*, the actual distance between the two attachment points 4, 5 is still preferably 5 mm. Accordingly, the tension element 8 is still under stress even in the closed position of the closure. With respect to the relaxed position in accordance with FIG. 8*a* or FIG. 8*b*, the change in length still is more than 6%. The maximum elastic change in length of the tension elements 8 is advantageously selected to be between 10% and 50%. But this depends to a large extent on the geometric conditions. In addition to the percentage change of length, however, the pulling force exerted by the tension element is important. This is affected on the one hand by the geometric design of the tension element and, on the other hand, by the material strength of the partial sections. So that no deformation of the closure itself occurs, it is practical to make the wall thickness of the partial sections considerably less than the wall thickness of the shell walls in the area of the attachment points. If the percentage of the maximum elastic change in length is designed too small, then the snap effect only takes place in the range of dead center. As a lower limit, a 10% change in length in the area of dead center would be sensible.

As already shown by the few preferred embodiments in accordance with the drawings, the choice of the different variants in the design of the closures in accordance with the invention is almost unlimited. This is a very important advantage, especially for plastic snap hinge closures Almost every manufacturer of cosmetic products, food or technical chemicals desires a special design adapted to the packaging of its products. The designed now actually has almost unlimited possibilities available with the help of the hinge according to this invention.

I claim:

1. In a plastic snap hinge closure having at least one first film hinge connecting a lower part and an upper part, and at least one tension element having two opposite end portions each attached to a corresponding closure wall of each of said lower part and said upper part, the improvement comprising: said at least one tension element comprising a plurality of adjacent partial sections forming a continuously elastic strap in a closed position of said hinge closure, a second film hinge and a third film hinge per each said at least one tension element, said second film hinge formed between said upper part and each said at least one tension element, said third film hinge formed between said lower part and each said at least one tension element, each said continuously elastic strap lying within an approximate plane defined between said second film hinge and said third film hinge in said closed position, said adjacent partial sections meandering through a plurality of curved turns within said approximate plane, and during a pivotal movement of said upper part with respect to said lower part about an axis of rotation of said at least one first film hinge each said partial section elastically deforms to cause a change in a length of each said partial section.

2. In a closure in accordance with claim 1, wherein each of said at least one first film hinge is positioned on a console protruding outward with respect to said corresponding closure wall of each of said lower part and said upper part.

3. In a closure in accordance with claim 1, wherein said second film hinge and said third film hinge of said at least one tension element are aligned with said closure walls.

4. In a closure in accordance with claim 1, wherein said second film hinge and said third film hinge of said at least one tension element are positioned parallel to each other.

5. In a closure in accordance with claim 1, wherein said second film hinge and said third film hinge of said at least one tension element are positioned at an angle with respect to each other within said approximate plane in said closed position.

6. In a closure in accordance with claim 5, wherein there are two of said at least one tension element which are symmetrically positioned on both sides of said at least one first film hinge which hingedly connects said lower part and said upper part.

7. In a closure in accordance with claim 1, wherein each partial section of said at least one tension element extends arcuately in said plane between said second film hinge and said third film hinge in said closed position.

8. In a closure in accordance with claim 7, wherein said partial sections arcuately verge into each other and form said continuously elastic strap which meanders in said approximate plane between said second film hinge and said third film hinge in said closed position.

9. In a closure in accordance with claim 7, wherein each said partial section is C-shaped.

10. In a closure in accordance with claim 7, wherein each said partial section is U-shaped.

11. In a closure in accordance with claim 7, wherein each said partial section is O-shaped.

12. In a closure in accordance with claim 1, wherein said partial sections of said at least one tension element are positioned so that they meander in a serpentine fashion in said approximate plane between said second film hinge and said third film hinge in said closed position.

13. In a closure in accordance with claim 1, wherein there are two of said at least one first film hinge and one of said at least one tension element, said one tension element positioned between said two first film hinges wherein said two first film hinges hingedly connect said lower part to said upper part.

14. In a closure in accordance with claim 1, wherein there is one of said at least one first film hinge and two of said at least one tension element, each said tension element is positioned on opposite sides of said one first film hinge which hingedly connects said lower part and said upper part.

15. In a closure in accordance with claim 1, wherein a material thickness of said partial sections is significantly less than a wall thickness of said closure walls in an area of said second film hinge and said third film hinge.

16. In a closure in accordance with claim 1, wherein said at least one tension element is elastically deformable between 2% and 25% of an at rest length of said one tension element.

* * * * *